United States Patent [19]

Berman

[11] Patent Number: 4,494,467

[45] Date of Patent: Jan. 22, 1985

[54] APPARATUS AND TECHNIQUE FOR COMBUSTION OF METHANOL OR SIMILAR FUELS

[76] Inventor: Daniel Berman, Harav Friedman 49, Tel Aviv, Israel

[21] Appl. No.: 369,611

[22] Filed: Apr. 19, 1982

[51] Int. Cl.[3] ..... F23B 7/00; C01B 2/14

[52] U.S. Cl. ..... 110/234; 48/197 R; 110/212; 122/4 R

[58] Field of Search ..... 431/1, 2; 122/136 R, 122/4 R, 5, 10; 110/234, 211, 212, 215; 48/196 R

[56] References Cited

U.S. PATENT DOCUMENTS

| | | | |
|---|---|---|---|
| 3,176,634 | 4/1965 | Martin | 110/212 |
| 3,265,040 | 8/1966 | Chen | 122/4 R |
| 3,680,500 | 8/1972 | Pryor | 110/212 |
| 3,690,550 | 9/1972 | Hilberath et al. | 48/196 R |
| 3,711,258 | 1/1973 | Matthews | 48/196 R |
| 3,861,334 | 1/1975 | Stockman | 110/212 |
| 3,886,873 | 6/1975 | Sundqvist et al. | 122/5 R |
| 3,898,057 | 8/1975 | Moller et al. | 48/214 A |
| 4,245,569 | 1/1981 | Fallon | 110/215 |
| 4,356,778 | 11/1982 | McRee, Jr. | 110/212 |
| 4,368,677 | 1/1983 | Kline | 110/212 |

*Primary Examiner*—Henry C. Yuen

*Attorney, Agent, or Firm*—Browdy and Neimark

[57] ABSTRACT

Apparatus for combustion of methanol and similar fuels comprising first combustion apparatus receiving a supply of methanol or similar fuel for heating thereof and removing the water content thereof, thereby producing steam, second combustion apparatus disposed above the first combustion apparatus and in fluid communication therewith for combustion of hydrocarbon fuel resulting from the operation of the first combustion apparatus; and utilization apparatus receiving steam from the first combustion apparatus.

1 Claim, 1 Drawing Figure

APPARATUS AND TECHNIQUE FOR COMBUSTION OF METHANOL OR SIMILAR FUELS

FIELD OF THE INVENTION

The present invention relates to hydrocarbon fuel combustion apparatus generally and more particularly to apparatus for combustion of methanol and similar fuels.

BACKGROUND OF THE INVENTION

The production of methanol has been of significant interest in recent years due to concern over dwindling supplies of fossil fuels, particularly those based on petroleum. Methanol has been considered as an alternative to petroleum based fuels because it is readily produced by a number of alternative techniques, including among them techniques which employ renewable sources of hydrocarbon materials. Source materials for the production of methanol include, for example agricultural products, including agricultural waste products such as "biomass" and coal.

A particular characteristic of methanol and other alcohol based fuels, such as ethanol, is that they contain a very high percentage of water, up to about 45% Normally in combustion of methanol, this water is converted to steam and the steam is lost through the chimney together with the remaining combustion gases.

SUMMARY OF THE INVENTION

The present invention seeks to provide apparatus for combustion of methanol and similar fuels which provides significantly higher efficiency than presently attainable using conventional apparatus.

There is thus provided in accordance with an embodiment of the present invention apparatus for combustion of methanol and similar fuels comprising first combustion apparatus receiving a supply of methanol or similar fuel for heating thereof and removing the water content thereof, thereby producing steam, second combustion apparatus disposed above the first combustion apparatus and in fluid communication therewith for combustion of hydrocarbon fuel resulting from the operation of the first combustion apparatus; and utilization apparatus receiving steam from the first combustion apparatus.

Further in accordance with an embodiment of the present invention, the utilization apparatus may comprise a first heat exchanger for heating a liquid from the steam Additionally in accordance with an embodiment of the present invention a second heat exchanger may be provided in communication with exhaust gases from the second combustion apparatus.

Further in accordance with an embodiment of the present invention, there is provided a technique for combustion of methanol or similar fuels comprising the steps of heating methanol to convert it to methane and steam, passing the steam to a heat exchanger for utilization thereof, and passing the resulting methane to a combustion location for combustion thereof and heating of a desired fluid.

BRIEF DESCRIPTION OF THE DRAWINGS

The present invention will be more fully understood and appreciated from the following detailed description taken in conjunction with the drawing in which.

DETAILED DESCRIPTION OF A PREFERRED EMBODIMENT

Figure 1:
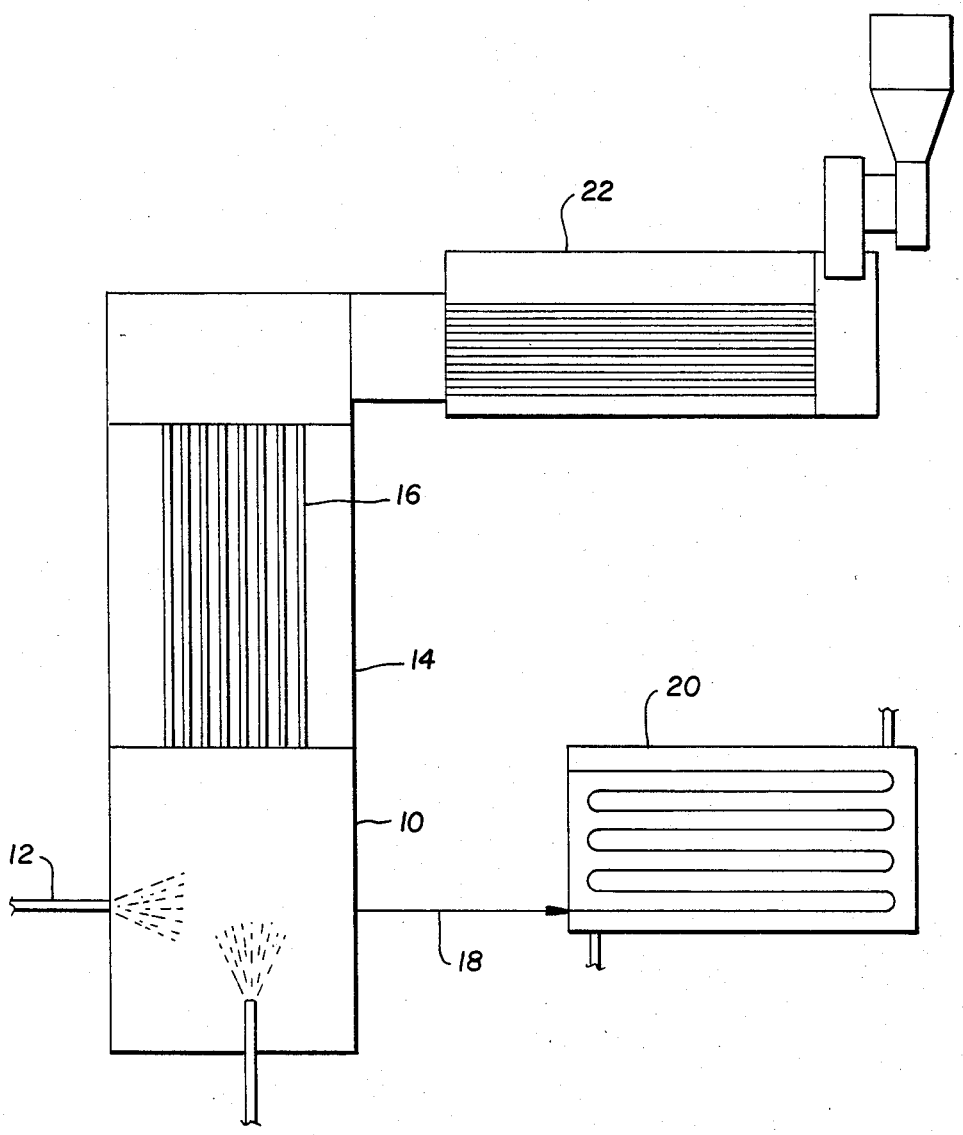
FIG. 1 is a schematic illustration of apparatus for combustion of methanol or similar fuels constructed and operative in accordance with an embodiment of the present invention.

Reference is now made to FIG. 1 which illustrates a preferred embodiment of combustion apparatus constructed and operative in accordance with the present invention. The apparatus of FIG. 1 comprises a first combustion chamber 10, which typically receives a supply of methanol or any suitable similar fuel having a high percentage of water such as alcohol fuels.

First combustion chamber 10 also typically receives a heat from combustion of fossil fuel via communications conduit 12. The combustion of the fossil fuel is operative to heat the methanol, typically to a temperature of about 250° C. at which the methanol is converted to methane and gives up its water content as steam.

The water molecules are produced as superheated or saturated steam which is known to have a lower partial pressure under identical conditions of temperature and pressure than methane or carbon monoxide. The carbon monoxide and methane rises into a second combustion chamber 14, typically comprising a plurality of vertical fire tubes 16 which define a heat exchanger for heating of water or any other fluid. Within tubes 16, the combustion of methane occurs.

The superheated or saturated steam, due to its lower partial pressure does not rise into the second combustion chamber 14 but instead passes through a conduit 18 directly from the first combustion chamber 12 to a heat exchanger 20 in which heat from the steam is used to heat water or any other desired fluid or combination of fluids in a conventional manner.

The exhaust gases from the fire tubes 16 pass vertically therethrough and are supplied to a waste heat boiler 22, which is in effect a heat exchanger operated by passage of the exhaust gases therethrough for heating water or any other desired fluid.

In accordance with an embodiment of the present invention there is thus provided a technique for combustion of methanol or similar fuels having a high percentage of water comprising the steps of first heating the fuel to remove the water and to produce steam therefrom, removing the steam to utilization apparatus, such as a heat exchanger, and then combusting the resulting fuel. The waste gases from the fuel combustion may, of course, be used in a further heat exchanger.

It will be appreciated by persons skilled in the art that the present invention is not limited by what has been particularly shown and described hereinabove. Rather the scope of the present invention is defined only by the claims which follow:

I claim:

1. A technique for combustion of methanol or other alcohol based fuel containing a high percentage of water, comprising the steps of:

feeding methanol or other alcohol based fuel to a first combustion chamber;

heating methanol to about 250° C. or other alcohol fuel to convert it to steam and a hydrogen fuel in said first combustion chamber;

passing the resultant hydrocarbon fuel upwardly to a second combustion chamber for combustion thereof and burning said hydrocarbon fuel in said second combustion chamber to produce heat;

supplying the steam from said first combustion chamber horizontally to utilization apparatus for heating a fluid thereby;

and supplying combustion products from the second combustion chamber to a heat exchanger for heating of a fluid thereby.

* * * * *